US008611065B2

(12) United States Patent
Riskin

(10) Patent No.: US 8,611,065 B2
(45) Date of Patent: Dec. 17, 2013

(54) METHOD AND DEVICE FOR AUTOMATIC POSITIVE AND NEGATIVE ION BALANCE CONTROL IN A BIPOLAR ION GENERATOR

(76) Inventor: Yefim Riskin, Katzrin (IL)

( * ) Notice: Subject to any disclaimer, the term of this patent is extended or adjusted under 35 U.S.C. 154(b) by 90 days.

(21) Appl. No.: 13/232,092

(22) Filed: Sep. 14, 2011

(65) Prior Publication Data

US 2012/0069485 A1 Mar. 22, 2012

(30) Foreign Application Priority Data

Sep. 19, 2010 (IL) ..... 208218

(51) Int. Cl.

| | |
|---|---|
| ***H01H 23/00*** | (2006.01) |
| *H01T 23/00* | (2006.01) |
| *H05F 3/00* | (2006.01) |
| *G03G 15/02* | (2006.01) |

(52) U.S. Cl.
USPC ..... 361/230; 361/231; 361/235

(58) Field of Classification Search
USPC ..... 361/230, 231, 235
See application file for complete search history.

(56) References Cited

U.S. PATENT DOCUMENTS

| | | | | |
|---|---|---|---|---|
| 3,909,614 | A * | 9/1975 | Marshall | 250/324 |
| 4,096,543 | A * | 6/1978 | Kozuka et al. | 361/230 |
| 4,618,249 | A | 10/1986 | Minor | |
| 6,850,403 | B1 | 2/2005 | Gefter et al. | |
| 2006/0072279 | A1 | 4/2006 | Gefter et al. | |

* cited by examiner

*Primary Examiner* — Jared Fureman
*Assistant Examiner* — Lucy Thomas
(74) *Attorney, Agent, or Firm* — Pearl Cohen Zedek Latzer Baratz, LLP

(57) ABSTRACT

A method and a device for automatic positive and negative ion balance control in a bipolar ion generator. The method may include applying bias voltage from a bias voltage source to a bias electrode from a power supply that includes an AC voltage generator and a voltage multiplying circuit of at least one cascade. The method may also include controlling a bias current flowing through the bias electrode for the purpose of stabilization of that current, wherein the step of controlling of the bias current is performed during charging of a capacitor in the voltage multiplying circuit.

5 Claims, 1 Drawing Sheet

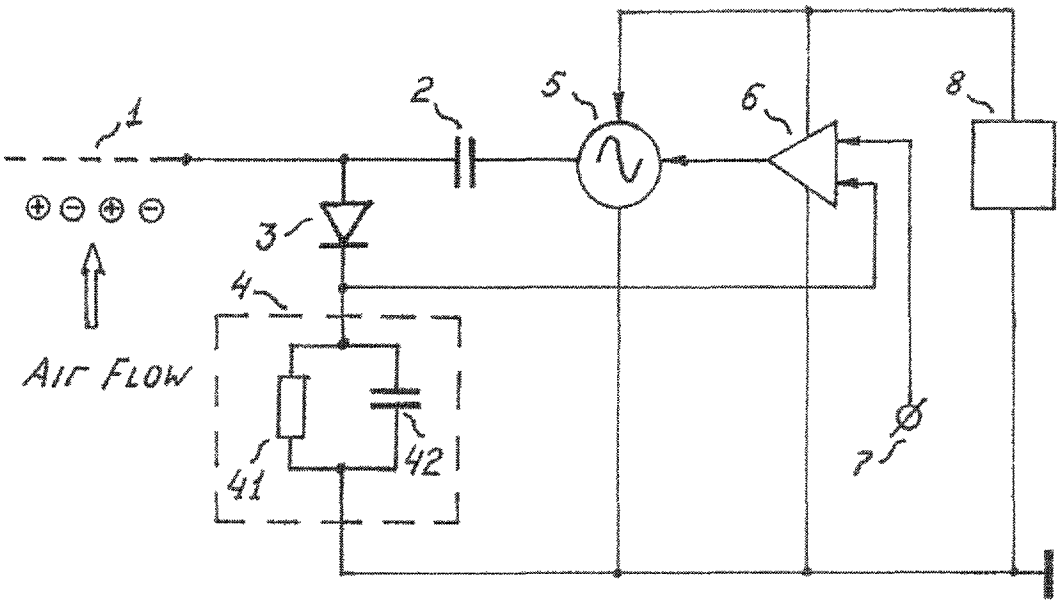
1
2
3
4
41
42
5
6
7
8
Air Flow

METHOD AND DEVICE FOR AUTOMATIC POSITIVE AND NEGATIVE ION BALANCE CONTROL IN A BIPOLAR ION GENERATOR

PRIOR APPLICATION DATA

This application claims the benefit of prior Israel application 208218 filed Sep. 19, 2010, incorporated by reference in its entirety.

FIELD OF THE INVENTION

A method and a device according to embodiments of the present invention are related to automatic ion balance control in bipolar ion generators that use AC or DC ion emission from needle or wire electrodes.

BACKGROUND

A device for balancing positive and negative ion output in bipolar generators is known which comprises a bias electrode (e.g. grid) and a controlled bias voltage source, the high voltage terminal of the such generators being connected to the bias electrode, while the low voltage terminal thereof is grounded (refer to US patent Application Publication 2006/0072279 A1).

Also a device is known for automatic balance control of positive and negative ions at the output of bipolar ion generator (refer to U.S. Pat. No. 4,618,249). The device includes a conducting grid connected to two variable resistors via diodes with different polarity connection. The resistance of the resistors is adjusted by a signal applied from a special balance sensor (electrometer) so that balance between positive and negative ions at the object is achieved.

The drawbacks of this technique are as follows:

1. Low sensitivity of the ion balance sensor which is more distanced from the ionizing electrode than the bias electrode (grid).
2. Low accuracy of ion balance adjustment due to the stepped adjustment of the resistor resistance values.
3. Complexity of realization of the device.

Further, a device is known for automatic ion balance adjustment in bipolar ion generators (refer to U.S. Pat. No. 6,850,403 B1). The device includes: bias electrode (grid), regulated bias voltage source isolated from ground; the high voltage terminal of the said voltage source being connected to the bias electrode, while the low voltage terminal thereof is grounded via a balance sensor. The balance sensor is a resistor. The sensor output voltage which is proportional to the bias current is compared with the reference voltage to generate a correction signal which is applied to the control input of the bias voltage source.

The drawback of the technique is the low sensitivity of the ion balance sensor caused by the bias current and the earth leakage currents from the bias voltage source which is isolated from the ground flowing through the sensor.

The leakage currents from the isolated voltage source are much higher than the bias current; moreover they are strongly dependent on ambient temperature and humidity.

BRIEF DESCRIPTION OF DRAWINGS

FIG. 1 illustrates a device for automatic ion balance control in a bipolar ion generator, in accordance with an embodiment of the present invention.

BRIEF DESCRIPTION OF THE INVENTION

In accordance with embodiments of the invention there is provided a method for automatic positive and negative ion balance control in a bipolar ion generator. The method may include applying bias voltage from a bias voltage source to a bias electrode from a power supply that includes an AC voltage generator and a voltage multiplying circuit of at least one cascade. The method may also include controlling a bias current flowing through the bias electrode for the purpose of stabilization of that current, wherein the step of controlling of the bias current is performed during charging of a capacitor in the voltage multiplying circuit.

In accordance with embodiments of the invention, the bias voltage source is grounded.

In accordance with embodiments of the invention, there is provided a device for automatic positive and negative ion balance control in a bipolar ion generator. The device may include a bias electrode. The device may also include a bias voltage source that includes a controlled AC voltage generator and a voltage multiplying circuit of at least one cascade, a resistor for bias current control through the bias electrode, a terminal for connecting to a reference voltage source, a comparator for comparing the reference voltage with voltage drop across the resistor and for controlling the AC voltage generator. The resistor for bias current control is located in a capacitor charging circuit of the voltage multiplying circuit.

In accordance with embodiments of the invention an additional capacitor is connected in parallel with the resistor for bias current control to provide charging conditions to the capacitor in the voltage multiplying circuit.

In accordance with embodiments of the invention low voltage terminals of the resistor for bias current control, the controlled AC voltage generator and the voltage multiplying circuit are interconnected and grounded.

DETAILED DESCRIPTION

The objective of the invention is to eliminate the drawbacks of the existing methods and devices of automatic ion balance control in bipolar ion generators.

The proposed device and method are based on the use of the charging and discharging processes in a capacitor of a voltage multiplying circuit.

Voltage multiplying circuit include a single multiplying cascade that includes a capacitor and a diode connected in series, whereas the free capacitor terminal is connected to the high voltage terminal of the AC voltage generator, and the free diode terminal is connected to the low voltage terminal thereof. The output of the multiplying circuit is connected to the connection point common for the capacitor and the diode.

The circuit forms two separate circuits for the capacitor charging and discharging. The capacitor is charged through the capacitor—diode circuit when the diode is open for a certain polarity of the AC voltage generator.

The capacitor is discharged through the capacitor—output terminal circuit of the multiplying circuit at the opposite polarity of the AC voltage generator when the diode is closed.

The capacitor charging and discharging currents are typically of equal value but opposite polarity.

This enables measuring the capacitor charging current in a circuit with grounded power source instead of measuring the output current of multiplying circuit or of the bias voltage supply integrally as demonstrated in the known devices where the power supply must be isolated from the ground.

To do so a resistor, which serves as the bias current sensor, can be connected in the capacitor charging circuit, for example, between the free diode terminal and the ground.

Here a contradiction occurs. Because of very high resistance of the resistor (typically tens of Mega Ohms) required to register very small bias currents, the capacitor charging during the AC voltage generator pulse becomes impossible.

In order to resolve the contradiction it will suffice to connect in parallel to the resistor an additional capacitor with larger capacitance (with respect to the first capacitor) with very low reactance at the AC generator frequency.

In practice at an AC generator frequency of 20-100 KHz and a capacitor capacitance in the multiplying circuit of 100 pF, the capacitance of the additional capacitor can be set in the range of 10-100 nF.

A device realizing the proposed method includes a bias electrode, AC voltage generator, at the least one cascade of a voltage multiplying circuit, bias current sensor, comparator as well as a common power supply.

FIG. 1 illustrates a device for automatic ion balance control in a bipolar ion generator, in accordance with an embodiment of the present invention.

The device may include the following parts: bias electrode 1 (grid), capacitor 2 and diode 3, which form a single cascade of the voltage multiplying circuit, bias current sensor 4 which comprises resistor 41 and capacitor 42 connected in parallel, controlled AC voltage generator 5, comparator 6, terminal used to connect the reference voltage source 7 and common power supply of the device 8.

Electrode 1 is connected to the first terminal of capacitor 2 and diode 3, whereas the other terminal of diode 3 is connected to one of the terminals of sensor 4 and the second terminal of sensor 4 is grounded.

The second terminal of diode 3 is connected also to one of the inputs of comparator 6, while the second input thereof is connected to the terminal 7 used to connect the reference voltage source.

The output terminal of comparator 6 is connected to the control input of AC voltage generator 5, whereas the high voltage terminal of AC voltage generator 5 is connected to the second terminal of capacitor 2.

Input terminals of AC generator 5 and comparator 6 are connected to the respective terminals of the power supply 8.

The device operation is as follows:

Bias electrode 1 is mounted in air flow containing positive and negative ions, that are generated by a bipolar ion generator (not shown in this figure).

External positive and negative ions balance meter may be used to determine the imbalance degree at a certain air flow velocity.

Then the bias current is set using the reference voltage source connected at terminal 7 so as to achieve maximal balance between the positive and negative ions in the air flow.

As the air flow velocity is changed the bias current through the bias current sensor 4 is changed too; comparator 6 output signal is applied to AC generator 5 which maintains the bias current at the preset set level by adjusting the output voltage of AC generator 5.

The claimed method and device enable to achieve balance of ±1 V through the use of a simpler device embodiment as distinct from the known devices which provide balance of ±5 V.

The invention claimed is:

1. A method for automatic positive and negative ion balance control in a bipolar ion generator comprising:

applying bias voltage from a bias voltage source to a bias electrode from a power supply that includes an AC voltage generator and a voltage multiplying circuit of at least one cascade;

controlling a bias current flowing through the bias electrode for the purpose of stabilization of that current using a balance sensor located in a capacitor charging circuit of the voltage multiplying circuit, wherein sensing of the bias current by the balance sensor is performed only during charging of a capacitor in the voltage multiplying circuit.

2. The method of claim 1, wherein the bias voltage source is grounded.

3. A device for automatic positive and negative ion balance control in a bipolar ion generator comprising:

a bias electrode;

a bias voltage source that includes a controlled AC voltage generator and a voltage multiplying circuit of at least one cascade, a resistor for bias current control through the bias electrode, a terminal for connecting to a reference voltage source, a comparator for comparing the reference voltage with voltage drop across the resistor and for controlling the AC voltage generator, wherein the resistor for bias current control is located in a capacitor charging circuit of the voltage multiplying circuit.

4. The device of claim 3, wherein an additional capacitor is connected in parallel with the resistor for bias current control to provide charging conditions to the capacitor in the voltage multiplying circuit.

5. The device of claim 3, wherein low voltage terminals of the resistor for bias current control, the controlled AC voltage generator and the voltage multiplying circuit are interconnected and grounded.

* * * * *